US005377987A

United States Patent [19]

Irvin, Jr.

[11] Patent Number: 5,377,987

[45] Date of Patent: Jan. 3, 1995

[54] GOLF PUTTER AND METHOD FOR PUTTING

[76] Inventor: James H. Irvin, Jr., 4414 Piper Glen Dr., Charlotte, N.C. 28277

[21] Appl. No.: 242,772

[22] Filed: May 16, 1994

[51] Int. Cl.[6] ..... A63B 69/36

[52] U.S. Cl. ..... 273/194 R; 273/167 A; 273/80.2; 273/164.1

[58] Field of Search ..... 273/167 R, 167 A, 174, 273/80.1, 80.2, 167 G, 80 C, 164.1, 193 R, 194 R, 187.4, 194 R, 192, 191 R, 186.2, 77 R

[56] References Cited

U.S. PATENT DOCUMENTS

| | | | |
|---|---|---|---|
| Re. 33,169 | 2/1990 | Leek | 273/80 C |
| 1,517,476 | 12/1924 | Tyler | 273/80 C |
| 2,843,384 | 7/1958 | Schmidt | 273/77 B X |
| 3,680,868 | 8/1972 | Jacob | 273/167 A |
| 3,806,129 | 4/1974 | Burrows | 273/167 A |
| 4,073,492 | 2/1978 | Taylor | 273/80 C |
| 4,077,633 | 3/1978 | Studen . | |
| 4,688,799 | 8/1987 | Johnson | 273/174 |
| 4,964,639 | 10/1990 | Tucker . | |
| 5,172,915 | 12/1992 | Flis | 273/167 A |
| 5,286,027 | 2/1994 | Koumarianos . | |
| 5,308,063 | 5/1994 | Vendur | 273/80.2 |
| 5,314,184 | 5/1994 | Schmidt | 273/80.2 |

*Primary Examiner*—Sebastiano Passaniti
*Attorney, Agent, or Firm*—Bell, Seltzer, Park & Gibson

[57] ABSTRACT

There is provided a golf ball putter having an elongated shaft which includes a gripping handle at one end and a putter head affixed to the other end. The putter head has ball striking surface having a length greater than its height, a bottom surface, a top surface, a rear surface. The bottom surface and top surface are joined by a toe end and a heel end. A pivot is formed on the bottom surface of the putter head proximate the heel end and extends therefrom. The elongated shaft is affixed to the putter head at a substantially right angle. A method for using the putter is provided wherein the putter head is aligned behind the ball to direct it toward the cup and the putter head is then rested on the pivot. The shaft is then rotated around the pivot to strike the ball.

5 Claims, 1 Drawing Sheet

GOLF PUTTER AND METHOD FOR PUTTING

BACKGROUND OF THE INVENTION (1) Field of the Invention

The present invention relates to improvements in golf putting. More particularly, this invention relates to a golf putter which permits axial rotation of the putter shaft by the golfer to be utilized in striking a golf ball.

(2) Description of the Prior Art

Since the beginning of golf, players have sought ways to obtain lower scores. One approach to lower scores is through improved equipment. As a consequence, there are many designs for golf putters which attempt to aid the golfer in the alignment of putts for better accuracy and for improving the manner in which the putter interacts with the golf ball during the putting stroke. There continues to be a desire for a method for putting which enables the golfer to have greater accuracy in striking the ball and directing the ball towards the cup.

The normal method of striking a golf ball is to grip the club in such manner as to swing the club with both arms extended across the body from side to side. This method of striking a golf ball is normally used where maximum impact against the ball is used. When putting, the same stroke is used but accuracy not impact is desired. However, when putting the normal stroke tends to introduce inaccuracies into the swing due to movement of the player's body, head and hands while putting. With a conventional stroke wherein the arms move the putter head through the ball, it is difficult to establish and maintain an accurate alignment of the ball and the cup with player's eye throughout the swing.

SUMMARY OF THE INVENTION

It is therefore an object of the present invention to provide an improved method for putting a golf ball which permits the player to maintain an accurate alignment and control while striking a golf ball.

Another object of the present invention is to provide an improved golf putter in which the putter head and shaft are formed so as to enable the golfer to rotate the shaft so that the ball striking surface of the putter strikes the ball.

It has been found that these objects are accomplished by the present invention in which there is provided a golf ball putter having an elongated slender shaft which includes a gripping handle at one end and a putter head affixed to the other end. The putter head has ball striking surface having a length greater than its height, a generally flat bottom surface, a top surface, a rear surface, said bottom surface and said top surface being joined by a toe end portion and a heel end portion. A pivot is formed on the bottom surface of the putter head and extends therefrom. The pivot is preferably located proximate the heel end portion. The elongated shaft is affixed to the putter head at a substantially right angle. In a preferred embodiment, the elongated shaft extends through the putter head. The ball striking surface is preferably substantially vertically planar. The pivot may be formed in any desirable shape but is preferably round or hemispherical.

The method of the present invention is carried out using the improved putter which has a handle, an elongated slender shaft and a putter head having a ball striking surface, a bottom surface, a heel portion and a toe portion, and a pivot formed on the bottom surface proximate the heel portion wherein the striking surface of the putter is held behind the ball above the surface of the green and aligned with the hole. When the alignment is made the putter head is placed on the green resting on the pivot behind the ball. When the putter is aligned and positioned for putting, the putter is grasped in the gripping area in a manner for easy rotation of the elongated shaft during the swing. The putter handle is then rotated in a manner so as to strike the ball directing it towards the cup.

With the various methods above described, not only does the ball's striking surface remain aligned when the putter shaft is rotated, but also the player's body and head remain stable.

BRIEF DESCRIPTION OF THE DRAWINGS

Other objects, features and advantages of the present invention will become apparent from the following detailed description taken in conjunction with the accompanying drawings in which.

DETAILED DESCRIPTION OF PREFERRED EMBODIMENTS

Figures 1, 2, 3:
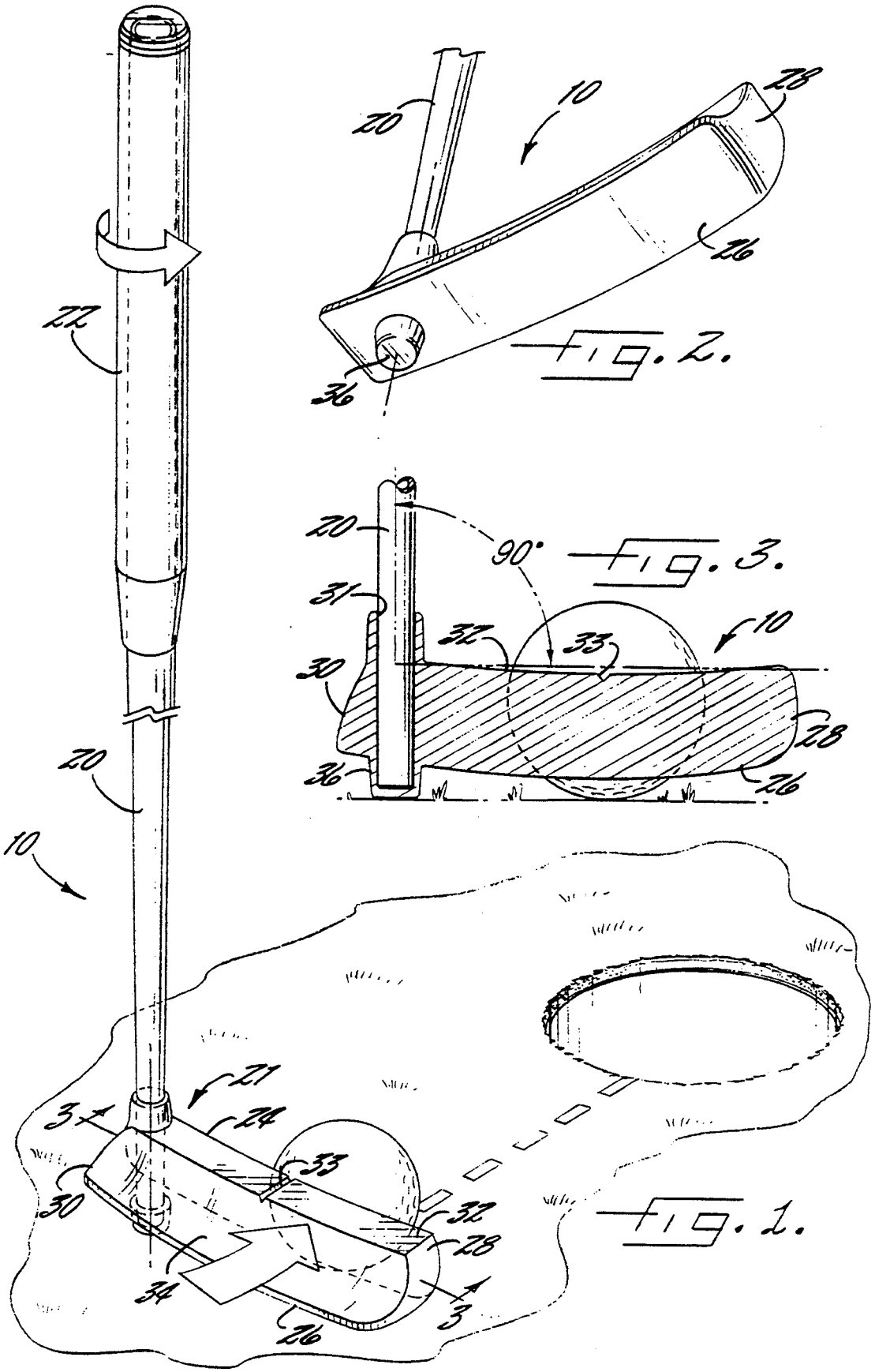
FIG. 1 is an environmental view showing a preferred embodiment of the putter of the present invention in position to strike a golf ball.
FIG. 2 is a perspective view of the putter of the present invention illustrating the pivot.
FIG. 3 is a cut-away rear view of the putter head and shaft assembly of the present invention as shown along line 3—3 of FIG. 1.

Referring first to FIG. 1, there is shown an environmental view of the putter 10 of the present invention as used by a golfer in performing the method of this invention. The putter 10 includes an elongated slender shaft portion 20 having a gripping handle 22 at one end and a putter head 21 affixed to the other end.

The elongated slender shaft 20 is generally straight and its length may vary depending upon the height of the golfer. The elongated shaft 20 is affixed at the heel end portion 30 of the putter head 21 so as to permit the axial rotation thereof. As shown most clearly in FIG. 3 the elongated shaft 20 is affixed to said putter head 21 at a substantially right angle. The elongated shaft 20 may be affixed in any number of well known ways but in a preferred embodiment the elongated shaft 20 extends substantially through hole 31 in putter head 21 near the heel end portion 30. As will be evident from the description of the method of using the putter, it is important that the shaft and putter head 21 be at such angle to each other that axial rotation of the elongate shaft 20 is facilitated. Although the shaft is affixed to the putter at a substantially right angle it may have a dog leg whereby the putter shaft actually is affixed to the putter head at a location not directly in line with the axis of the shaft.

The putter head 21 has a ball striking surface 24, a bottom surface 26, a top surface 32 and a rear surface 34. The bottom surface 26 and the top surface 32 are joined by a toe end portion 28 and a heel end portion 30. The ball striking surface 24 preferably has a length from heel end portion to toe end portion greater than its height. The heel end portion 30 of putter head 24 is typically oriented toward the player when executing a putt and the toe end portion 28 is typically oriented away from the player during the putt. The rear surface 34 may be of a variety of shapes. The ball striking surface 24 is preferably substantially vertically planar but it is understood that the ball striking surface may have grooves or even be non-planar. The top surface 32 may contain aligning aids 33 such as printed indicia or a slight groove in the top surface. The bottom surface 26 is generally flat but may have a slight curvature especially at the heel end portion and toe portions as shown in FIG. 3. The size of the putter head is a conventional size, typically about four inches long, 1 to 1½ inches wide and ¾ to 1¼th inches high.

As shown most clearly in FIG. 2, a pivot 36 is formed on the bottom surface 26 and extends therefrom substantially in alignment with a longitudinal axis extending through the elongated shaft (20). The pivot surface being located proximate said heel end portion 30. The height of the pivot 36 should be sufficient for the ball striking surface 24 to easily clear the green when the shaft is rotated. The pivot 36, which rests on the ground during the putt, may be of many suitable shapes and sizes but preferably the pivot is round with a flat bottom or hemispherical- The pivot is preferably of such size that it does not stick into or otherwise injure the surface of the putting green. Because of the pivot, the ball striking surface 24 rests slightly above the surface of the green as shown in FIG. 3 and passes over any debris on the surface of the green beneath the putter head. While ordinarily the putter head may be weighted or otherwise balanced in some fashion, such aids are not needed with the putter of this invention.

MODE OF OPERATION

An important aspect of this invention is the method of using the putter. The heel end portion 30 of the putter head 24 is typically oriented toward the golfer when executing a putt and the toe end portion 28 is typically oriented away from the golfer during the putt. The swing is carried out by aligning the midpoint of the ball striking surface 24 with the direction of desired travel of the ball. To do so a preferred method is to stand behind the ball holding the putter head 24 above the surface of the green. Once the putter is properly aligned, the putter head 24 is lowered to the green allowing the putter head to rest on the pivot 36. The elongated shaft 20 of the putter is best grasped with one hand over the end of the grip 22. The player, upon aligning the shot, may stand to either side of or even behind the ball while rotating the elongated shaft 20. The free hand may be used to further stabilize the putter shaft. Because only the putter shaft is rotated by twisting of the wrist or fingers, the shoulders, head and legs of the player do not move and thus the player remains stable throughout the swing. The freedom of movement for the wrist and fingers provide more accurately the amount of force applied to the ball. Because only the putter head pivots, the alignment is not altered by the rotation. Thus, the method provides accurate control of direction and force of contact between the ball and putter.

While the present invention has been described in connection with the exemplary embodiments thereof, it will be understood that any modifications will be apparent to those of ordinary skill in the art and that this application is intended to cover any adaptations or variations thereof. Therefore, it is manifestly intended that this invention be only limited by the claims and equivalents thereof.

What is claimed is:

1. A golf ball putter comprising:

an elongated shaft having a gripping handle at one end and a putter head affixed to the end opposite said gripping handle;

said elongated shaft being affixed to said putter head at a substantially right angle with respect to a horizontal axis extending between the heel end portion and the toe end portion of the putter head;

said putter head having a ball striking surface having a length greater than its height, a bottom surface, a top surface, a rear surface, said bottom surface and said top surface being joined by a toe end portion and a heel end portion; and a single pivotal member formed on said bottom surface and extending therefrom, said pivotal member being located proximate said heel end portion and substantially in alignment with a longitudinal axis extending through said elongated shaft.

2. The golf ball putter according to claim 1 wherein said shaft extends substantially through said putter head.

3. The golf ball putter according to claim 1 wherein said ball striking surface is substantially vertically planar.

4. The golf ball putter according to claim 1 wherein said pivot is round.

5. A method of putting a golf ball using a putter having a shaft, a gripping handle at one end of the shaft and a putter head affixed to the end opposite said gripping handle comprising;

aligning said putting head having a ball striking surface, a bottom surface, a heel portion and a toe portion, and a pivot formed on said bottom surface proximate said heel portion;

placing the pivot of said aligned putting head behind said ball; and stroking said ball by rotating said putter shaft along its axis in a manner so as to direct a ball towards a cup.

* * * * *